US009205645B2

(12) United States Patent
Koerner

(10) Patent No.: US 9,205,645 B2
(45) Date of Patent: Dec. 8, 2015

(54) METHOD TO CONTROL THE PRINTING ELEMENTS OF AN INK PRINT HEAD OF AN INK PRINTING APPARATUS

(71) Applicant: Philippe Koerner, Munich (DE)

(72) Inventor: Philippe Koerner, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/614,661

(22) Filed: Feb. 5, 2015

(65) Prior Publication Data

US 2015/0217564 A1 Aug. 6, 2015

(30) Foreign Application Priority Data

Feb. 5, 2014 (DE) ..... 10 2014 101 428

(51) Int. Cl.
*B41J 2/045* (2006.01)

(52) U.S. Cl.
CPC ..... *B41J 2/04541* (2013.01)

(58) Field of Classification Search
CPC ..... B41J 2/04541; B41J 2/04588; B41J 2/04596; B41J 2/04573
See application file for complete search history.

(56) References Cited

U.S. PATENT DOCUMENTS

| | | | | |
|---|---|---|---|---|
| 6,431,674 | B2 | 8/2002 | Suzuki et al. | |
| 6,715,852 | B2 | 4/2004 | Yonekubo | |
| 8,857,935 | B2 * | 10/2014 | Endo et al. | 347/10 |
| 8,870,324 | B2 | 10/2014 | Buschmann | |
| 2004/0113960 | A1 | 6/2004 | Usui | |
| 2007/0285448 | A1 | 12/2007 | Nakamura | |

FOREIGN PATENT DOCUMENTS

| | | | |
|---|---|---|---|
| DE | 601 25 265 | T2 | 7/2007 |
| DE | 697 36 991 | T2 | 7/2007 |
| DE | 10 2012 107 776 | A1 | 2/2014 |
| EP | 0788882 | B1 | 7/2002 |

* cited by examiner

*Primary Examiner* — Thinh Nguyen
(74) *Attorney, Agent, or Firm* — Schiff Hardin LLP

(57) ABSTRACT

In a method to control printing elements of an ink print head for ejection of a respective ink droplet, respective control voltages are applied to activators of the printing elements. The control voltages comprise at least one vibration voltage pulse that induces at least one vibration oscillation in the associated printing element, and an associated print dot voltage pulse that induces an ejection of the respective ink droplet by the associated printing element. The at least one vibration voltage pulse is chronologically arranged before the associated print dot voltage pulse, and an amplitude of the at least one vibration voltage pulse is respectively chosen depending on a size of the respective ink droplet to be subsequently emitted by the respective printing element.

9 Claims, 3 Drawing Sheets

METHOD TO CONTROL THE PRINTING ELEMENTS OF AN INK PRINT HEAD OF AN INK PRINTING APPARATUS

BACKGROUND

Ink printing apparatuses can be used for single-color or multicolor printing of a printing substrate, for example a single sheet or a web-shaped recording medium made of the most varied materials (paper, for example). The design of such ink printing apparatuses is known—see for example EP 0 788 882 B1.

Ink printing apparatuses that operate according to the Drop on Demand (DoD) principle have a print head or multiple print heads that respectively provide a plurality of printing elements. A piezoelectric printing element thereby comprises a piezoactivator that is arranged at an ink channel that is connected with a nozzle. Controlled by control voltages from a printer controller, the activators excite ink droplets in the direction of the printing substrate, which ink droplets are directed onto the printing substrate in order to apply print dots there for a print image. These control voltages are derived from the image to be printed (the print data).

In an ink printing apparatus, the ink that is used is adapted in terms of its physical/chemical composition to the print head; for example the ink is adapted with regard to its viscosity. Given low print utilization, in the printing process not all printing elements of the print head are activated; many printing elements have downtimes, with the consequence that the ink in the ink channel of these printing elements is not moved. Due to the effect of the evaporation from the nozzle opening, the danger exists that the viscosity of the ink then changes. This has the result that the ink in the printing element can no longer move optimally and exit from the nozzle. In extreme cases, the ink in the printing element dries completely and then clogs its nozzle, such that a printing with this printing element is no longer possible.

A drying of the ink in the printing elements of a print head in its downtimes represents a problem that can be prevented in that a flushing medium (for example ink or cleaning fluid) is flushed through all nozzles of the print head within a predetermined cycle. This flushing cycle can be set corresponding to the print utilization.

Furthermore, from DE 697 36 991 T2 (EP 0 788 882 B1) it is known to remedy the difficulties in the ejection of ink droplets that are caused by the change of the viscosity of the ink in the printing elements in that the piezoelectric activators of the printing elements are respectively set into vibration oscillations (also called prefire or meniscus oscillations) before or after a printing process, such that no ink droplets are ejected but the ink meniscus that projects out of the nozzle is moved so that the ink in the printing elements is thoroughly mixed. For this, control voltages are applied to the activators of the printing elements, the control voltages having a smaller amplitude and shape in comparison to the control voltages generating a print dot. It can thereby be achieved that the ink situated at the nozzle openings mixes with the ink located inside the printing elements so that the ink droplets can again be generated under approximately normal conditions in printing operation.

SUMMARY

It is an object to specify a method according to which the printing elements of a print head can be set such that the danger of a change of the viscosity of the ink in the ink channels and the nozzles of the printing elements is kept as small as possible, for example in order to avoid a crosstalk between adjacently situated printing elements and in order to avoid an unwanted pressure wave superposition in the printing elements.

In a method to control printing elements of an ink print head for ejection of a respective ink droplet, respective control voltages are applied to activators of the printing elements. The control voltages comprise at least one vibration voltage pulse that induces at least one vibration oscillation in the associated printing element, and an associated print dot voltage pulse that induces an ejection of the respective ink droplet by the associated printing element. The at least one vibration voltage pulse is chronologically arranged before the associated print dot voltage pulse, and an amplitude of the at least one vibration voltage pulse is respectively chosen depending on a size of the respective ink droplet to be subsequently emitted by the respective printing element.

DESCRIPTION OF EXEMPLARY EMBODIMENTS

Figure 1:
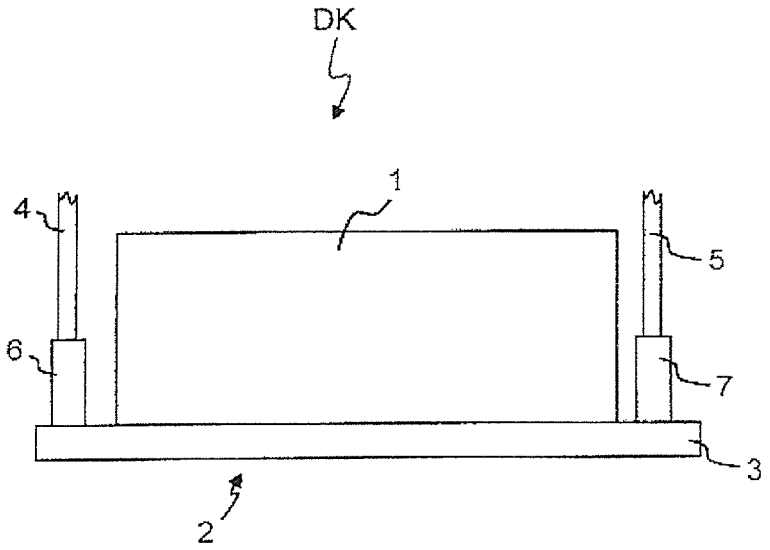
FIG. 1 is a principle representation of a print head in a view from the front.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In a method to control the printing elements of an ink print head of an ink printing apparatus, control voltages are respectively applied to the activators of the printing elements of the print head, which control voltages are composed of: print dot voltage pulses that trigger the ejection of ink droplets; and one or more vibration voltage pulses per print dot voltage pulse, which vibration voltage pulses induce the thorough mixing of the ink in the printing elements via vibration oscillations. The amplitude of the vibration voltage pulses can thereby respectively be chosen depending on the size of the ink droplets following the vibration voltage pulses—for example depending on the duration of these print dot voltage pulses—but such that the printing elements eject no ink droplets upon application of the vibration voltage pulses. The vibration voltage pulses can be arranged before the associated print dot voltage pulses. It is advantageous if a wait time is inserted between the vibration voltage pulses and the associated print dot voltage pulse, which wait time can amount to at least one printing clock period, for example. The wait time can also be chosen depending on the printing speed or the ink volume of the ink droplets.

Advantages of the exemplary embodiment are:

- Avoidance of nozzle stoppages during ramp-up printing and continuous printing due to the
- reduction of interferences of pressure waves in the printing elements, which interferences can lead to air bubbles in the ink channels;
- reduction of acoustic crosstalk (crosstalk to adjacent ink channels).
- Reduced power consumption, therefore less heating of the print head.
- Optimization of the prefire intensity, i.e. reduction of the necessary number of vibration pulses.

Exemplary embodiments shown in the schematic drawing figures will now be described. FIG. 1 schematically shows an example of a print head DK that has a housing 1 for a control circuit and printing elements whose nozzles 2 are situated in a nozzle plate 3. Furthermore, a supply conduit 4 for the infeed of ink to the respective printing element and a supply conduit 5 for a discharge of ink from the respective printing element are provided. The nozzles 2 in the nozzle plate 3 are respectively coupled via ink channels with activators via which the ejection of ink droplets in the direction of a recording medium is induced when a voltage pulse of sufficient amplitude (called a print dot voltage pulse in the following) has been supplied from the control unit to the corresponding activator. The supply of ink to the nozzle 2 or the discharge of ink from the nozzle 2 respectively take place with a feeder clamp 6 or 7 for the supply conduit 4 or 5.

In operation, ink is supplied to the nozzles 2 arranged in the nozzle plate 3 via ink channels connected with the supply conduit 4. If the activator associated with a nozzle 2 is controlled via the control circuit with a print dot voltage pulse, this nozzle 2 ejects an ink droplet; in contrast to this, no ink is ejected at the remaining nozzles 2 that are not activated.

The print image generated on the recording medium by the ink droplets is adjusted via the volume of the ink droplets fired from the nozzles 2. The adjustment of the ink volume can take place in that the activators of the printing elements are operated with different print dot voltage pulses.

Figure 2:
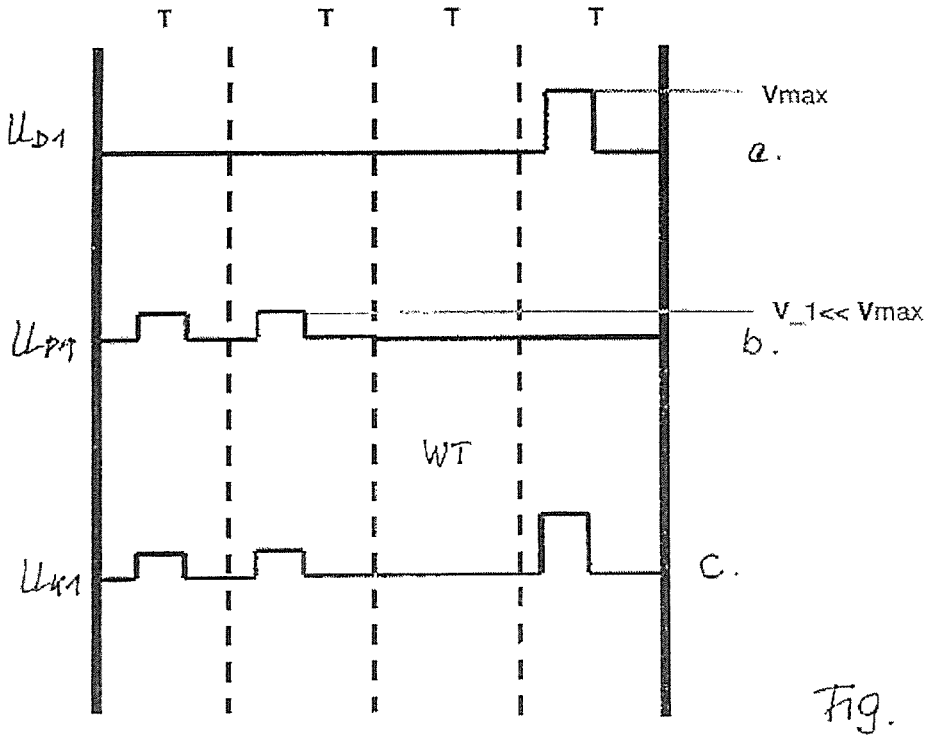
FIG. 2 show waveforms of control voltages for the activators of the printing elements of a print head given an ink droplet of first volume, wherein the waveform for ejection of the print dot, the waveform to generate vibration pulses and the combination of these waveforms are shown.
Figure 3:
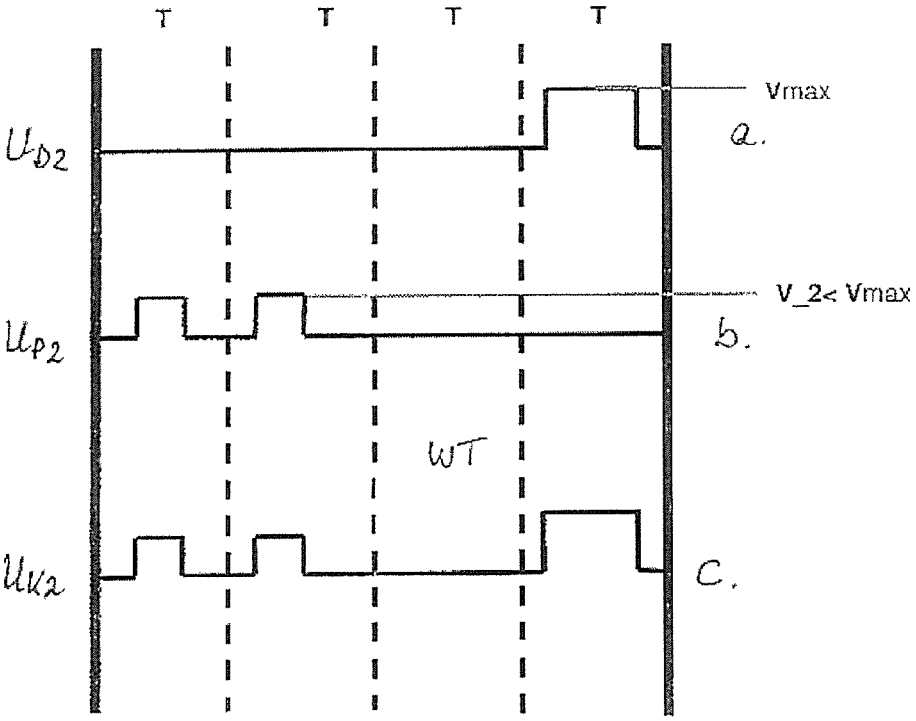
FIG. 3 illustrates waveforms of control voltages for the activators of the printing elements of a print head given an ink droplet of second volume, wherein the waveform for ejection of the print dot, the waveform to generate vibration pulses and the combination of these waveforms are shown.
Figure 4:
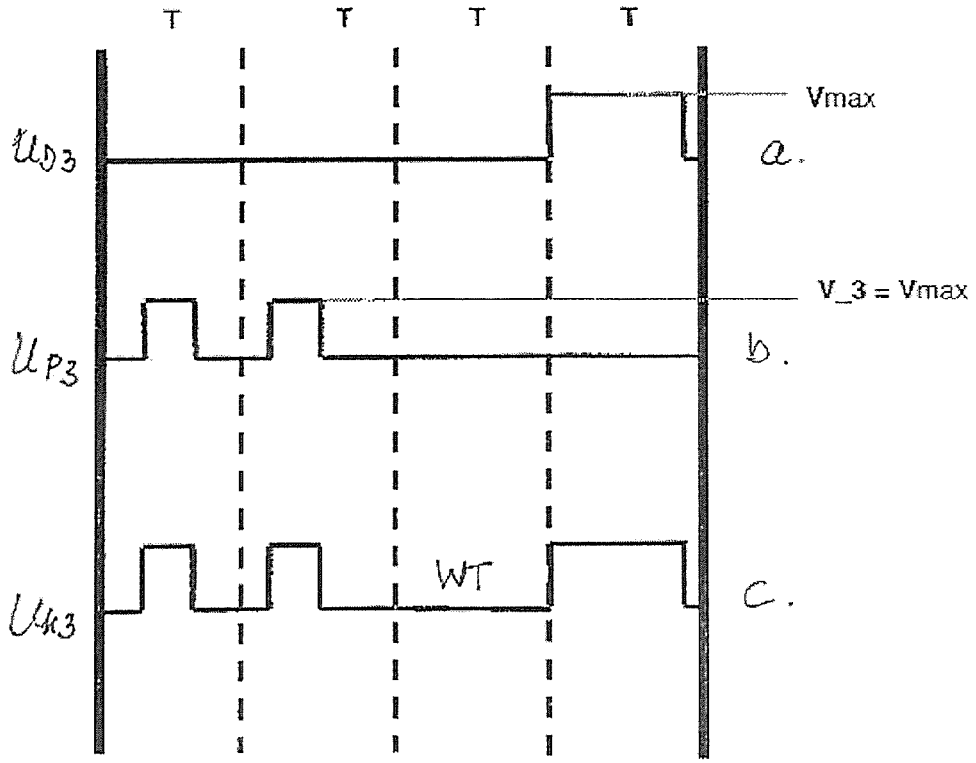
FIG. 4 illustrates waveforms of control voltages for the activators of the printing elements of a print head given an ink droplet of third volume, wherein the waveform for ejection of the print dot, the waveform to generate vibration pulses and the combination of these waveforms are shown.

FIG. 2 through FIG. 4 show examples of control voltages $U_K$ (FIG. 2*c*, FIG. 3*c*, FIG. 4*c*) for the printing elements that include waveforms

- of print dot voltage pulses $U_D$ for activators of printing elements in order to generate ink droplets of different volume or size (FIG. 2*a*, FIG. 3*a*, FIG. 4*a*);
- of vibration voltage pulses $U_P$ that induce the activators to vibrations in the printing elements (FIG. 2*b*, FIG. 3*b*, FIG. 4*b*).

FIG. 2*a* shows a waveform of a print dot voltage pulse $U_{D1}$ with which (for example) ink droplets with a volume of 5 pl (picoliters) are generated at a given print head; FIG. 3*a* shows a waveform of a print dot voltage pulse $U_{D2}$ with which (for example) ink droplets with a volume of 7 pl can be generated; and FIG. 4*a* shows a waveform of a print dot voltage pulse $U_{D3}$ with which ink droplets with a volume of (for example) 12 pl can be generated. These waveforms are merely strongly schematically depicted examples. For example, these print dot voltage pulses $U_D$ have the same amplitudes but different pulse duration. The duration of the print dot voltage pulses is set to be greater with increasing volume of the ink droplets to be ejected.

In order to counteract an unwanted change of the viscosity of the ink in the printing elements, prefire or vibration voltage pulses $U_P$ for generation of vibration oscillations in the printing elements can be provided, for example before occurrence of a print dot voltage pulse $U_P$. The number of vibration voltage pulses $U_P$ and their duration is selectable depending on the use case. The amplitude of the vibration amplitude pulses $U_P$ is thereby chosen to be smaller than or equal to that of the associated print dot voltage pulses $U_D$; however, the amplitude of the vibration voltage pulses $U_P$ is set depending on the pulse duration of the print dot voltage pulses, and therefore on the size of the fired ink droplet. The longer the pulse duration of the print dot voltage pulse $U_D$, the greater the amplitude of the associated vibration voltage pulses $U_P$, wherein the amplitude of the vibration voltage pulses $U_P$ is always to be chosen so that the printing elements eject no ink droplets.

FIG. 2*b* shows one possible waveform of vibration voltage pulses $U_{P1}$ given a print dot voltage pulse $U_{D1}$ in the case of FIG. 2*a*. Here two vibration voltage pulses $U_{P1}$ are provided as an example. The amplitude V1 of the voltage of the two vibration voltage pulses $U_{P1}$ is chosen to be much smaller than Vmax (V1=22 V, for example) if Vmax is the amplitude of the print dot voltage pulse $U_{D1}$ (Vmax=28 V, for example).

FIG. 3*b* shows a waveform of vibration voltage pulses $U_{P2}$ given a print dot voltage pulse $U_{D2}$ in the case of FIG. 3. Here two vibration voltage pulses $U_{P2}$ are provided as an example. The amplitude V2 of the voltage of the two vibration voltage pulses $U_{P2}$ is chosen to be smaller than Vmax (V2=24 V, for example) if Vmax is the voltage amplitude of the print dot voltage pulse $U_{D2}=U_{D1}$ (Vmax=28 V, for example).

FIG. 4*b* shows a waveform of vibration voltage pulses $U_{P3}$ given a print dot voltage pulse $U_{D2}$ in the case of FIG. 4. Here again, two vibration voltage pulses $U_{P3}$ are provided as an example. The amplitude V3 of the voltage of the two vibration voltage pulses $U_{P3}$ is chosen to be the same as Vmax if Vmax is the voltage amplitude of the print dot voltage pulse $U_{D3}=U_{D2}=U_{D1}$ (Vmax=28 V, for example).

The control voltage $U_K$ that is supplied to the activators of the printing elements is then composed of a combination of the vibration voltage pulses $U_P$ and the print dot voltage pulse $U_D$. These control voltages $U_K$ that are used in printing are shown in FIG. 2*c*, FIG. 3*c*, FIG. 4*c*. If printing elements should fire no ink droplets, a control voltage $U_{K1}$ according to FIG. 2*c* is supplied to their activators. If printing elements should fire ink droplets of medium size, a control voltage $U_{K2}$ according to FIG. 3*c* is applied to their activators. If printing elements should emit large ink droplets, a control voltage $U_{K3}$ according to FIG. 4*c* is supplied to their activators.

In order to avoid interferences of the pressure waves that are triggered by the vibration voltage pulses $U_P$ with the pressure waves of the print dot voltage pulses $U_D$, a wait time WT can be observed between the vibration voltage pulses $U_P$ and the associated print dot voltage pulses $U_D$; for example, at least one printing clock period T can be chosen as a wait time WT (for example T=Pixel/((a0*t+v0)), wherein t=time, v0=substrate velocity; a0=substrate acceleration). The control voltage $U_K$ that is applied to the printing elements is then composed of a series of vibration voltage pulses $U_P$, a wait time WT and a print dot voltage pulse $U_D$. This series is shown in FIG. 2*c*, FIG. 3*c* and FIG. 4*c* for the print dot voltage pulses $U_D$ of FIG. 2*a*, FIG. 3*a*, FIG. 4*a*.

The number of vibration voltage pulses $U_P$ that are arranged before a print dot voltage pulse $U_D$ can be chosen corresponding to the use case, for example depending on the print speed. The duration of the print dot voltage pulses $U_D$ depends on the size of the ink droplets. The amplitude of the vibration voltage pulses $U_P$ is chosen depending on the duration of the print dot voltage pulses $U_D$ and can be determined in test series. It is thereby to be heeded that the magnitude of the vibration voltage pulses $U_P$ may be chosen only so that the printing elements that are activated solely with the vibration voltage pulses $U_P$ emit no ink droplets.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to control printing elements of an ink print head for ejection of a respective droplet in an ink printing apparatus, comprising the steps of:

providing the printing elements with a respective ink channel ending in a nozzle and an activator arranged at the ink channel;

applying respective control voltages to the activators of the printing elements, said control voltages comprising at least one vibration voltage pulse that induces at least one vibration oscillation in the associated printing element, and an associated print dot voltage pulse that induces an ejection of the respective ink droplet by the associated printing element; and arranging chronologically the at least one vibration voltage pulse before the associated print dot voltage pulse, and an amplitude of the at least one vibration voltage pulse being respectively chosen depending on a size of the respective ink droplet to be subsequently emitted by the respective printing element.

2. The method according to claim 1 in which the amplitude of the at least one vibration voltage pulse is chosen depending on a duration of the associated print dot voltage pulse.

3. The method according to claim 1 in which at least two respective vibration voltage pulses are arranged before one print dot voltage pulse.

4. The method according to claim 1 in which a wait time is observed between the at least one vibration voltage pulse and the associated print dot voltage pulse.

5. The method according to claim 4 in which at least one printing clock period is chosen as said wait time.

6. The method according to claim 4 in which the wait time is set depending on a print speed.

7. The method according to claim 4 in which the wait time is set depending on a volume of the respective ink droplet.

8. The method according to claim 1 in which a piezoactivator is used as said activator.

9. A method to control printing elements of an ink print head for ejection of a respective droplet in an ink printing apparatus, comprising the steps of:

providing the printing elements with a respective ink channel ending in a nozzle and an activator arranged at the ink channel;

applying respective control voltages to the activators of the printing elements, said control voltages comprising at least two vibration voltage pulses that induce at least two respective vibration oscillations in the associated printing element, and an associated print dot voltage pulse that induces an ejection of the respective ink droplet by the associated printing element; and arranging chronologically the at least two vibration voltage pulses before the associated print dot voltage pulse, a last of the two vibration voltage pulses being spaced by a wait time from the print dot voltage pulse, and an amplitude of the at least two vibration voltage pulses being respectively chosen depending on a size of the respective ink droplet to be subsequently emitted by the respective printing element.

* * * * *